United States Patent [19]

Boswell et al.

[11] Patent Number: 4,977,947

[45] Date of Patent: Dec. 18, 1990

[54] METHOD AND A DEVICE FOR HOMOGENIZING THE INTIMATE STRUCTURE OF METALS AND ALLOYS CAST UNDER PRESSURE

[75] Inventors: Peter Boswell, Carouge; Guy Negaty-Hindi, Onex; Tatiana Berce, Geneva, all of Switzerland

[73] Assignee: Battelle Memorial Institute, Carouge, Switzerland

[21] Appl. No.: 471,432

[22] Filed: Jan. 29, 1990

[30] Foreign Application Priority Data

Jan. 31, 1989 [EP] European Pat. Off. ..... 89810079.7

[51] Int. Cl.[5] ..... B22D 27/08; B22D 27/11

[52] U.S. Cl. ..... 164/71.1; 164/97; 164/900

[58] Field of Search ..... 164/97, 71.1, 900, 120, 164/319, 320, 321

[56] References Cited

U.S. PATENT DOCUMENTS

| | | | |
|---|---|---|---|
| 3,598,175 | 8/1971 | Olsson | 164/120 |
| 4,617,979 | 10/1986 | Suzuki et al. | 164/97 |
| 4,739,817 | 4/1988 | Hamajima et al. | 164/97 |

FOREIGN PATENT DOCUMENTS

| | | | |
|---|---|---|---|
| 4833496 | 10/1973 | Japan | 164/97 |
| 51069428 | 6/1976 | Japan | 164/97 |
| 60114536 | 6/1985 | Japan | 164/97 |
| 62238062 | 10/1987 | Japan | 164/97 |
| 2100613 | 1/1983 | United Kingdom | 164/900 |

OTHER PUBLICATIONS

Patent Abstracts of Japan, vol. 7, No. 1 (M-183) [1146], Jan., 1983; & JP-A-57160 568 (Sumitomo Keikinzoku Kogyo), Feb. 2, 1982, *Abstract*.

World Patents Index; file supplier, AN=-75-63397W/38, Derwent Publications Ltd., London, GB; & SU-A-433 721 (Voron Poly) Apr. 16, 1975, *Abstract*.

Patent Abstracts of Japan, vol. 10, No. 122 (M-476) [2179], May 7th, 1986; JP-A-60 250 866 (Toshiba Kikai K.K.), Nov. 12, 1985 *Abstract*.

Patent Abstracts of Japan, vol. 11, No. 332 (C-455) [2779], Oct. 29th, 1987; & JP-A-62 116 (Toyota Motor Corp), May 28, 1987 *Abstract*.

Patent Abstracts of Japan, vol. 4, No. 111 (M-25) [593], Aug. 9th, 1980; & JP-1-55 70 466 (Hitachi Seisakusho K.K.) May 27, 1980 *Abstract*.

*Primary Examiner*—Richard K. Seidel
*Assistant Examiner*—Rex E. Pelto
*Attorney, Agent, or Firm*—Cushman, Darby & Cushman

[57] ABSTRACT

Efficient in-situ stirring in pressure casting is difficult. Here, the casting die is provided with internal mechanical agitating means which allow homogeneous distribution of the partially solidified phase at temperatures near liquidus and of optionally incorporated reinforcing materials. One form of agitating means is a masher type plate which moves back and forth within the mould.

10 Claims, 1 Drawing Sheet

Figure 1:
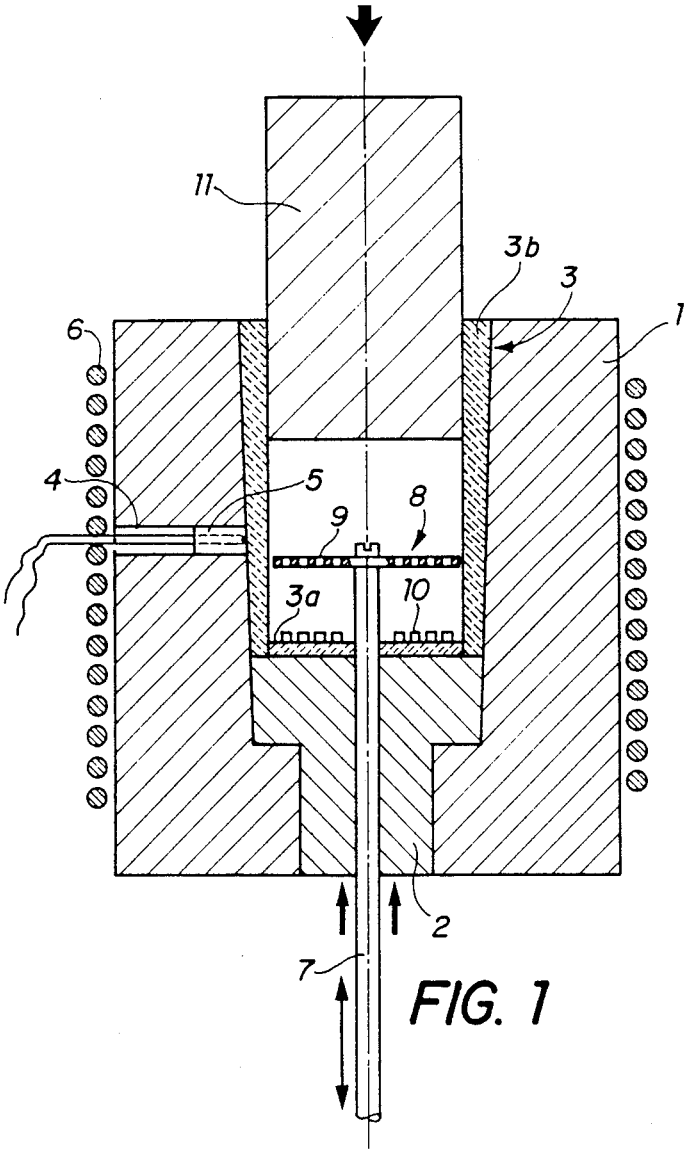

METHOD AND A DEVICE FOR HOMOGENIZING THE INTIMATE STRUCTURE OF METALS AND ALLOYS CAST UNDER PRESSURE

The present invention relates to the casting of metals and more particularly, to a method and device for combining the advantages of rheocasting and squeeze casting.

The technique of rheocasting is well established (Proceedings of Workshop at AMMRC (1977), MCIC Report, Columbus, Ohio; A. Vogel et al. "Solidification and Casting of Metals". The Metal Society (1979), London, p. 518; G. S. Reddy et al. (1985) J. of Mat. Sci. 20, 3535; R. T. Southin (1966) J. Inst. Mat. 94. 401). The idea of this casting method is that when metal alloys are vigorously agitated during solidification (semi-solid processing), the solid which forms has a special, non-dendritic structure. Partially solidified metals with this structure behave as highly fluid slurries at solid fractions as high as 60%. The process of taking a highly fluid, semi-solid, non-dendritic slurry and casting it directly is described as rheocasting. The mixing and blending action involved in rheocasting is of utmost importance in making metal matrix composite materials in which solid particulate materials are intimately incorporated to the castings. These particulate materials involve platelets, fibers, whiskers and fairly large particles (>5 μm), which may include special surface coatings to achieve improved wetting of the particles by the melt.

Squeeze casting was developed over 30 years ago but has been a dormant technology until the past decade. This process has also been referred to as "liquid metal forgoing" since high pressure is applied to the molten metal during solidification. (B. R. Franklin (1984) "Squeeze casting" British Foundryman 77 (4), 150). Other terms used for the same or similar process are "extrusion casting", "liquid pressing", "liquid metal stamping", "pressure crystallization" and "squeeze forming" (G. Williams et al. (1981) Metals Technology 8 (7), 263).

Squeeze casting using the so-called direct approach begins with pouring a quantity of molten metal into the bottom half of a die set mounted in a hydraulic press. The dies are then closed filling the die cavity with molten metal and applying pressure up to 210 $MN/m^2$ on the solidifying casting. Normally, pressure between 30–150 $MN/m^2$ are used. So the steps are as follows:

(a) A measured quantity of molten metal is poured into an open, preheated female die cavity located on the bed of a hydraulic press. Some initial cooling of the metal occurs before the application of pressure.

(b) The upper die or punch (male) is then lowered, coming into contact with the liquid metal and sealing the metal within the die, and continues to travel until the applied pressure has reached the desired level. The time elapsed before the application of pressure to be minimized to prevent premature solidification of the metal in the die.

(c) The pressure is maintained until all the molten metal has solidified. During this period the metal is forced into intimate contact with the die surfaces.

(d) The upper punch returns to its original position and the solidified casting is ejected.

The pressure produces a relatively rapidly solidified, pore-free, fine-grained part. The mechanical properties invariably exceed those of castings and generally fall midway between the longitudinal and transverse direction properties of wrought products. Costs are lower than forgoing because of cheaper starting materials, lower press tonnage, and less machining required.

However squeeze casting does not prevent a cooling gradient from establishing in the mold and consecutive inhomogeneities from appearing upon solidification, e.g. segregation and dendrite formation. Obviously combing squeeze casting and rheocasting is tempting.

C. S. Reddy (Indian Patent No. 161 152 A, 1987) has reported a squeeze casting apparatus which comprises a non-magnetic die for receiving a metal or alloy melt, an a.c.-driven stator, and a vertical ram for plunging into the die. The stator is to generate an electromagnetic field for stirring to prevent dendrite formation and it is braced with a water-cooled tubular coil. Experiments with a squeeze cast Al-4Cu-8Si alloy showed that the microstructure of castings carried out under stirring was superior to that of castings from an ordinary mould. Upon stirring, the alloy dendrited pattern was transformed into nearly spheroidal shape.

Although the above achievement had merit, the present inventors found that electromagnetic stirring is not entirely satisfactory in regard to smoothing the inhomogeneities in squeeze castings. Hence they devised the method disclosed in annexed claim 1 which gave improved results.

It should be pointed out at this stage that the present method is particularly appropriate to solve many problems associated with the manufacture of metal matrix composites normally produced by metal powder metallurgy or semi-solid processing and liquid metal infiltration.

Indeed, the key condition to obtaining high performance metal matrix composites is to achieve intimate adhesion and bonding of metal and mineral particles, i.e. good wetting of the reinforcement material by the metal in the fluid state.

However, in most matrix reinforcement systems, wetting is nil or unsignificant. This indicates that a substantial quantity of energy per unit area is required to force the liquid into intimate contact with the surface of the reinforcement.

In most everyday situations, wetting behavior and the related surface energy terms are negligible. However in the production of composite materials it is generally advantageous to use reinforcements of small diameter (below about 1–5 μm in radius). This implies a high ratio of surface area to volume ($=10^4$ $cm^2/cm^3$) and thus the surface energy terms are no longer negligible. This is particularly critical when using submicron fibers or whiskers with aspect ratios (ratio of length to diameter) exceeding 10.

The forces necessary to achieve sufficient contact between fluid metals and difficult-to-wet particles relate to the pressure in the bubbles of gas (or air) surrounding the particles in contact with molten metal. This pressure is given by the relation: $P=2T/r$ where T is the surface tension of the liquid metal and r is the average radius of the particle. Hence, in order to overcome surface tension in the case of small and very small particles, the pressure applied to the metal fluid must be increased.

In fact, most pressure-infiltration operations for the production of metal matrix composites utilize infiltration pressure in the range of 100 bar or more. Pressures of this order are required to force the molten alloy into the fine interstices between powder or fibrous reinforcements in cases where the molten alloy does not wet the reinforcement material. While pressures in this range are normally used in pressure die casting, there is the additional problem of how to support the reinforcement material (which is typically a rather brittle ceramic such as SiC or $Al_2O_3$) under these pressures so as to maintain the desired reinforcement distribution and orientation during infiltration.

One complicating aspect of these systems is gravimetric segregation. The reinforcement material usually has a density substantially different from that of the molten matrix alloy (usually lower if the matrix is Zn-Al). This means that if the liquid alloy/reinforcement mixture is left quiescent, the reinforcement will float to the surface of the melt. The rate at which this segregation occurs is related to the density difference between reinforcement and matrix, reinforcement surface area/volume ratio, and volume fraction solid. If the reinforcement is in the form of very fine powders or if the ratio of particles to matrix is high, the segregation takes place more slowly. Most structural composites utilize 15–40 vol % of reinforcement. This volume fraction is generally insufficient to prevent segregation. However, if a substantial fraction of the matrix alloy is present in a finely divided solid form, the total volume fraction solid is sufficient to prevent segregation. This situation may be achieved through semi-solid slurry processing, i.e. rheocasting, in which processing the metal is agitated while in partially solidified form. Semi-solid slurries produced in this manner have several interesting features. The slurry exhibits thixotropic behavior, which means that the viscosity of the slurry is inversely related to the shear rate. The more vigorous the agitation, the more fluid the slurry becomes.

This behavior is affected by the volume fraction of the solid phase, with a higher fraction solid, the viscosity is higher for a given shear rate or alternatively, more vigorous agitation is required to produce the same viscosity. If the fraction solid is $>30\%$, when the agitation is halted the shear rate in the slurry drops and the slurry "sets up" to form a relatively solid structure. However, if the agitation is restarted, the initial agitation torque will be quite high, but as the shear rate rises, the slurry becomes more fluid and the agitation torque will again drop exponentially with shear rate.

All the aforementioned advantages are achievable directly in the mold by carrying out the method of the present invention. As normally practiced, the technique here consists of introducing the reinforcement materials (powders, particles, fibers, whiskers, etc. .) into the mold before or together with the liquid metal or alloy and in-situ perform the necessary operation to achieve homogeneous semi-solid slurry processing, i.e. repeated cooling and heating across the liquidus. We shall see hereafter how this can be implemented within the scope of the invention.

The invention is now described in more detail with reference to the annexed drawing.

FIG. 1 represents schematically a squeeze casting die and ram system in which the alloy in fluid form can be mashed before it solidifies by mechanical means working inside the mould itself.

The device of FIG. 1 which can be operated with a press of conventional design for squeeze casting comprises a die 1 holding a shouldered extractor 2 and a mold 3. The die 1 and the extractor are made of steel or of another hard metal or alloy. The mold which comprises two parts, a bottom 3*a* and a frusto-conical sidewall 3*b*, can be made of ceramic or other material with low adhesion toward the metals or alloys to be cast therein. Alternatively, the mold can be made of steel but subjected to an antiadhesion treatment (spraying with a slurry of finely powdered ceramic) before casting. The internal walls of the die are frusto-conical to match with the external shape of the mould and to facilitate its extraction after solidification of the casting. A hole 4 is machined in the side of die 1 for housing a thermocouple 5. A heating coil 6 surrounds the die.

The extractor and the mold bottom 3*a* are pierced in the center to provide a passage for sliding therethrough a shaft with a masher or baffle 8 of ceramic or any other material not adhering to the metal casting, screwed (or fastened by any known means) on top of it. The bottom of the shaft is connected with a crank and rod attachment of conventional design (not represented) which can move it up and down controllably at will in order that the baffle displacement will span a given vertical distance from the bottom of the mold. The baffle is provided with a plurality of holes 9 which match with a plurality of pins 14 which protrude from the upper surface of the mold bottom 3*a*. When the baffle is in its lower rest position, the holes therein are plugged with the corresponding mating pins, this situation being to facilitate ultimate separation of the solidified casting.

The device finally comprises a ram 11 by means of which pressure can be applied to the mould by means of a press of conventional design.

In operation, the following steps are carried out: while the baffle is in a lower position, the mold heated to an appropriate temperature for casting by means of coil 6 is filled with molten metal or alloy (including or not including reinforcement materials). Then the ram 11 is lowered into the mold and pressed against the cast metal while the baffle 8 is moved up and down by means of the foregoing described mechanism. During the displacement of the baffle, the liquid metal is forced through holes 9, thus dividing it into a plurality of fluid streams which then intermingle with a high efficiency of mashing and blending capacity. This mashing is continued until the mass starts being too viscous upon cooling and partial solidification, whereby the baffle stops in its lower position, i.e. where it rests against the mould bottom 3*a* and the pins 10 plug the holes 9. In a variant, the drilled baffle plate can be replaced by a screen of selected mesh size in which case the pins 10 can be omitted.

When one wants to take advantage of the semi-solid slurry processing offered by the present arrangement, the temperature of the mixture is kept under control by suitable heating means, either using the coil 6 or heating means incorporated to the masher itself, or both. This can be achieved electrically (a resistor heater within the masher baffle or rod) or by hot fluid circulation.

Then the die and mold are allowed to cool as usual and, afterwards, by acting on the extractor 2, the mold and the casting are removed from the die. Note that the top of the baffle will not adhere to the bottom of the casting and can be detached easily for reuse.

This method which involves stirring the cooling metal by the mashing action of a baffle has the advantage over the prior agitating methods of considerable efficiency because the flowing metal is not only vibrated or mixed locally but it is really circulated all around in the mould with the added advantages of efficient grain refining, rapid cooling if desired and less or no shape deformation on solidification which will save eventual machining costs.

Furthermore, this mashing takes place in a volume entirely filled with metal with substantially no contamination with atmosphere whereby no residual gas can be entrapped in the molten metal as it often occurs with classical rheocasting. Therefore optimalized casting properties are attained.

It is of interest to somewhat concentrate on the various parameters which control the efficiency of the mashing operation which is used in this invention.

Calculations have shown that the pressure drop across the plate mixer when moved back and forth is:

$$\Delta p = \frac{f \cdot \eta \cdot V}{D_3}, \text{ where} \quad (1)$$

f is a factor (in the range 5 to 20) depending on mixer geometry and design, e.g. shape, and number and size of holes;

$\eta$ is the dynamic viscosity of the melt;

V is the average velocity of the mixer expressed as the volume flow rate ($cm^3$/sec) of mix passing through the mixer's holes, i.e. $\pi D^2 v$ where v is the actual velocity of the liquid metal streams in cm/sec;

D is the mixer's diameter.

Turbulent flow ensuring adequate mixing occurs when the expression $Dv\rho/\eta$ (Reynold's Number) is about 2 or greater ($\rho$ is the metal density).

Hence, after replacement, the pressure drop required for turbulent mixing flow is from (1)

$$\Delta p = \frac{2\pi f \eta^2}{D^2 \rho} \quad (2)$$

So the pressure drop required (equivalent to the pressure to be applied to the mixer) varies inversely with the square of the diameter.

According to another approach (T. W. Clyne et al., metallurgical Transactions 18A (1987), 1519), the onset of turbulence, i.e. good mixing for a mesh-type mixer (that is a mixer comprised of a undirectional bundle of cylindrical obstacles) arises when the pressure gradient across the mixer exceeds a critical value.

The pressure gradient is expressed as $\Delta p/H$, where H is the mixer's height. If the foregoing conditions are satisfied, then $$\frac{\Delta p}{H} > 67 \frac{1 - v^3}{rv} \times \frac{\eta^2}{\rho}, \text{ where} \quad (3)$$

v is the volume fraction of voids in the mixer;

r is the average radius of the mesh of the grid of the mixer, and $\eta$ and $\rho$ are defined as previously.

Using this expression, satisfactory turbulent mixing is obtained with a 10 MPa pressure drop (a value which can be attained practically with v=0.5, a mesh value radius of 0.1 cm and a mixer height of 0.3 cm.

The foregoing expressions (2) and (3) may be considered equivalent in that the theoretical mixer coefficient f (which depends on the mixer's configuration), is determined, for turbulent mixing, by the following relation:

$$f > \frac{34\, D^2\, H}{\pi} \quad \frac{1 - v^3}{rv}$$

indicating that for making f large (efficient mixer), r (the hole size) and v (the free volume fraction) should be kept small (only a few holes of small diameter) and a relatively thick mixer plate should be used.

It should also be stressed that the aforementioned technique allows incorporating into the alloy and thorough mixing therewith reinforcing materials (whiskers, short fibers, particles, flakes, platelets and the like) which can be added simultaneously when filling the mould with the molten metal or before casting. Such reinforcing materials can be selected from known reinforcing compounds, e.g. reinforcing ceramics or metal oxides (for instance crystalline or amorphous SiC, $Si_3N_4$, AlN, BN, etc. . ). Hence, this admixture of reinforcing agents can be brought about in only one step, while two steps are normally necessary with conventional rheocasting.

The very efficient and powerful mixing effect involved in this invention also improves the wetting by the molten metal of the reinforcing particles and, as a consequence, the homogeneity of the reinforced castings. Indeed, as discussed above in detail, effective wetting of small particles requires the application of pressure which increases proportionally to the decrease of the radius of curvature of the particle surface. Therefore, thorough wetting of very small particles is achieved under the very strong mixing pressures inherent in this invention.

Regarding the baffle motion, it should be noted that, in addition to reciprocal linear motion, complex motion is also possible; for instance, the baffle can be simultaneously rotated and moved up and down, the resulting streams in the liquid metal due to its passage through the holes in the baffle being then helical instead of linear.

Modified baffle construction can also be visualized, e.g. baffles whose external surface can vary during displacement to match a corresponding variation of the mold inside walls. For instance, a mold with progressively enlarging diameter can be used in combination with a baffle whose rim can correspondingly extend to keep in registration with the tapering mold walls. The construction of variable shape baffles is obvious to those skilled in the art and need not be developed here.

The following Examples illustrate the invention.

EXAMPLE 1

A squeeze-casting installation was used comprising a device as represented on FIG. 1 having the following approximate dimensions: diameter of the die 130 mm; top opening 60 mm; inside diameter of the mould 45 mm; height 80 mm; baffle and mold both made of stainless steel and surface protected by a release agent; holes in the baffle, diameter about 1.2–3 mm. The excursion of the baffle was 40 mm.

The die and mold assembly was heated to 600° C., and 150 g of molten 70/30 aluminum-silicon alloy maintained at 900° C., were poured into the mold.

A steel piston of 1 kg fitting into the mold opening was introduced therein and a pressure of 5 MPa was applied over it by a press while displacing the baffle up and down at a rate of 4 cm/s. Heating was discontinued and the assembly was allowed to cool at the rate of 2°–3° C./min.

After 7 min, the viscosity had increased considerably and the motion of the baffle was stopped and cooling was accelerated by forcing air on the mold.

After cooling, the casting sample was removed from the die and its internal structure examined by usual means.

By comparison with a control cast under identical conditions but with no mashing under pressure, the present sample showed a very fined grain and homogeneous structure.

EXAMPLE 2

A mold assembly of general structure similar to that discussed in Example 1 was used with a mixer comprising a double layer of 1 mm mesh steel wire screen. The mould cavity was 50 mm diameter by 70 mm long. It was heated to 210° C. and filled with molten (300° C.) Pb 30/Sn alloy (M. P. 270° C.).

The mold was closed as in Example 1 and a pressure of 5 bar was applied, the mixer was started at a rate of 0.3 m/sec and the alloy was allowed to come into thermal equilibrium with the mold under such dynamic conditions. Solids started to form during the approach to thermal equilibrium and when the temperature reached about 240° C. (corresponding to about 30% solids by volume), the pressure was increased ten fold and the die was forced cooled by air; motion of the baffle was continued for about 20 sec, then it was stopped, the screen resting against the bottom of the mold.

After opening the mould, the solidified alloy was found to contain a uniform distribution of roughly spherical Pb-rich particles (size about 5 μm) in a eutectic Pb-Sn matrix.

EXAMPLE 3

A set-up similar to that described in Example 2 was used with a plain carbon steel mould 50 mm (diameter) by 70 mm long. Before casting, the internal surface of the mold was coated with a conventional graphite/boron nitride release agent applied as a sprayed-on solution. The mixer baffle was a stainless (10 mm thick) plate with an array of 2 mm radius holes. The shaft 7 of the mixer was hollow and equipped with a heating coil connected to a generator. The heat developed there was transferred by conduction along the shaft to maintain the baffle plate at a given temperature.

The mold was heated to 400° C. and filled with molten A357 Al/Si/Mg casting alloy (held at a temperature of 660° C.) together with 20% by volume of 5 μm silicon carbide particles.

The mold was closed as usual and a uniaxial pressure of 2 MPa was applied while starting the reciprocal motion of the mixer (velocity 0.5 m/sec). When the temperature inside the mold was about 615° C., part of the alloy had started to solidify. The mixing was discontinued when further move of the mixer plate required an excessive effort (force exceeding 100 N) and the pressure was raised to 50 MPa increased to 0.2 m/sec. Forced air cooling was applied.

After solidification, examination of the alloy structure showed a very uniform distribution therein of the SiC particles in a fine-scale matrix comprising spheroidal dendrites of the primary aluminum solution (grain size about 2 μm) in a silicon rich eutectic matrix.

EXAMPLE 4

A mold and stirrer set-up as in the previous example was used (mold 50 mm (diameter) by 70 mm long). The alloy used was a Pb/80 wt% Sn mixture, MP ≅ 202° C. Before casting, SiC whiskers (Tokamax of Tokai Carbon, 2 μm, grade 2) were introduced into the mold; quantity of whiskers about 12% by vol. relative to the alloy. The mold was heated to 200° C. and filled with the molten alloy superheated to about 300° C. (100° C. above MP).

After closing the die, a pressure of 5 MPa was applied while starting the mixer at velocity of 0.1 m/sec. The mold was allowed to cool.

When the alloy temperature was within 10° C. of the liquidus, the mixing speed increased to 0.5 m/sec. When the resistance to further mixing increased to about 100 N due to progressive solidification of the alloy, the stirrer motion was stopped and the pressure was raised to 50 MPa. Cooling was continued under forced air.

After opening the mold, the alloy was found to contain a uniform non-agglomerated distribution of whiskers.

We claim:

1. A method for homogenizing the internal structure of a metal or alloy cast under pressure, said method comprising the steps of:

filling a heated mold with the metal or alloy, the metal or alloy being in molten form;

lowering a ram into the mold;

moving a baffle with openings therein along a vertical reciprocal path in the molten metal, thereby forcing the molten metal through the openings of the baffle to produce turbulent flow of the molten metal, the baffle moving with such a velocity so as to ensure adequate mixing of the metal before solidification occurs;

stopping the baffle at a lower position when the metal becomes excessively viscous upon partial solidification; and extracting the cast metal or alloy, said cast metal or alloy having a finely grained internal structure with microspheroidal cells.

2. The method of claim 1, further comprising the step of:

adding particulate reinforcement material to the mold one of before and concurrently to the filling step, said material being mixed by the movement of the baffle.

3. The method of claim 2, wherein the step of moving the baffle includes allowing bonding of the particulate reinforcement material with the metal.

4. The method of claim 2, wherein said adding step includes adding particulate material selected from the group consisting of metal oxides, ceramic powders, platelets, whiskers and long and short fibers.

5. A device for homogenizing the internal structure of a metal or alloy cast under pressure, said device comprising:

a die for holding a mold in which molten metal or alloy is poured for casting and a ram;

heating means external to the die for heating the die and the mold;

a ram means for fitting into an opening in an upper side of the mold, and for exerting pressure upon the molten metal during solidification; and mechanically driven baffling and stirring means for acting with the molten metal in the mold.

6. The device of claim 5, wherein the baffling means comprises a baffle plate that reciprocates in a vertical direction inside the mold, said baffle plate having holes therein through which the molten metal is driven by motion of said baffle plate.

7. The device of claim 6, wherein the baffle plate is fastened to a shaft slidable in a passage extending through the die and a lower wall of the mold, said shaft driven in reciprocating motion by means of a crank and a rod attachment.

8. The device of claim 6, wherein said baffling means are heated by an internal heater.

9. The device of claim 5, wherein an external shape of said baffling means corresponds with an internal shape of a cavity formed interior of the mold.

10. The device of claim 6, wherein a bottom interior surface of the mold is provided with plugging elements that mate with the holes of baffle plate when the plate is motionless on the bottom interior surface so that the baffle plate appears smooth and will not stick to a casting.

* * * * *